United States Patent [19]

Pike

[11] Patent Number: 4,689,242

[45] Date of Patent: Aug. 25, 1987

[54] METHOD FOR ADHESION OF GRIT TO BLADE TIPS

[75] Inventor: Roscoe A. Pike, Granby, Conn.

[73] Assignee: United Technologies Corporation, Hartford, Conn.

[21] Appl. No.: 887,509

[22] Filed: Jul. 21, 1986

[51] Int. Cl.[4] ..... B24D 11/02

[52] U.S. Cl. ..... 427/34; 51/295; 29/156.8 B; 427/204; 427/203

[58] Field of Search ..... 427/203, 204, 34; 51/295; 29/156.8 B

[56] References Cited

U.S. PATENT DOCUMENTS

| | | | |
|---|---|---|---|
| 2,694,647 | 11/1954 | Cole | 427/191 |
| 3,716,347 | 2/1973 | Bergstrom et al. | 29/182.2 |
| 4,155,721 | 5/1979 | Fletcher | 51/295 |
| 4,249,913 | 2/1981 | Johnson et al. | 51/295 |
| 4,369,098 | 1/1983 | Van Roeyen | 427/203 |
| 4,610,698 | 9/1986 | Eaton et al. | 51/295 |
| 4,643,740 | 2/1987 | Nicolson | 51/295 |

*Primary Examiner*—John H. Newsome
*Attorney, Agent, or Firm*—James M. Rashid

[57] ABSTRACT

Metal coated ceramic particles are bonded to a metallic substrate in a high temperature sintering process. A low viscosity binder solution containing fine metallic particulates is first applied to the substrate surface. Then, the coated ceramic particles are disposed upon the substrate surface, and the binder solution and the metal particulates therein are attracted by capillarity into regions of point contact between the ceramic particles and the substrate surface. During a subsequent high temperature sintering operation, the metal coating on the ceramic particles diffuses into the metal substrate, and the metallic particulates melt and solidify to bridge the gap between the substrate and ceramic particles.

6 Claims, 6 Drawing Figures

FIG. 1
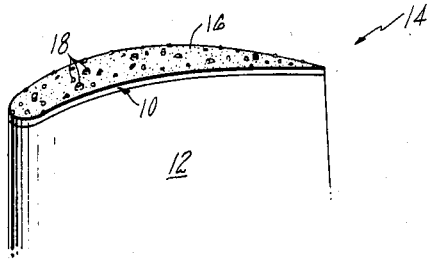
FIG. 3 PRIOR ART
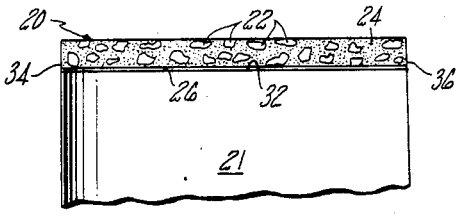
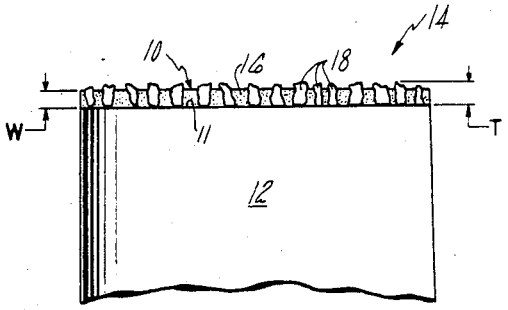
FIG. 2

METHOD FOR ADHESION OF GRIT TO BLADE TIPS

TECHNICAL FIELD

The present invention relates to a method for joining ceramic particles to a metal substrate. More specifically, it relates to a method for joining a single layer of closely spaced silicon carbide particles to the metallic surface of a turbine engine component.

BACKGROUND

Gas turbine engines and other turbomachines have rows of blades which rotate within a generally cylindrical case. As the blades rotate, their tips move in close proximity to the internal wall surface of the case. To maximize engine operating efficiency, the leakage of the gas or other working fluid between the blade tips and the case should be minimized. As has been known for some time, this may be achieved by blade and seal systems in which the blade tips rub against a seal attached to the interior of the case. Generally, the blade tip is made to be harder and more abrasive than the seal so that the tips cut into the seal during those portions of the engine operating cycle when they contact each other.

One type of blade tip which is particularly useful in the high temperature section of a gas turbine engine is described in U.S. Pat. No. 4,249,913 to Johnson et al, entitled "Alumina Coated Silicon Carbide Abrasive", of common ownership herewith. The contents of this patent are incorporated by reference. In the Johnson et al invention, silicon carbide abrasive particles of about 0.20–0.75 mm average diameter are coated with a metal oxide such as alumina and incorporated by powder metal techniques in nickel or cobalt base matrix alloys. A powder metal compact containing up to about 45 volume percent of these ceramic particles may be made which is then bonded to the tip of the blade. The resulting abrasive blade tip is particularly well suited for rubbing metal as well as ceramic seals.

As described in greater detail in the copending and commonly assigned application "Abrasive Surface Coating Process for Superalloys" to Eaton et al, U.S. Ser. No. 624,446, now U.S. Pat. No. 4,610,698 which is incorporated by reference, improved techniques for the fabrication of blade tips useful at high temperatures are desired. Specifically, the blade tip should be as thin as possible, and the amount of abrasive particles minimized. In order for the tip to provide the required abrasive characteristics, it is essential that the abrasive particles be securely bonded to the blade tip surface.

When an abrasive layer is provided on a superalloy turbine blade tip, its method of application must be metallurgically compatible with the superalloy substrate so that the properties of the substrate are not degraded. Such considerations place restraints on the kinds of materials and processing techniques which are useful in the fabrication of such abrasive layers.

DISCLOSURE OF THE INVENTION

According to the invention, a method for joining a plurality of ceramic particles to the surface of a metallic article used at elevated temperatures comprises the steps of: (a) depositing on each particle a multiple layer coating comprising a first oxide layer which is chemically stable at elevated temperatures and a second metal layer capable of diffusing into the article surface; (b) coating the article surface with a binder solution consisting essentially of a low viscosity carrier liquid, a thermoplastic resin, and metal particulates substantially smaller than the ceramic particles, the particulates capable of diffusing into the metal layer on each particle and into the article surface; (c) disposing a single layer of the ceramic particles in closely spaced relation on the article surface, wherein the carrier liquid and particulates therein are attracted by capillarity to the regions where each particle contacts the article surface; and (d) heating the article to diffuse a portion of the metal coating on each ceramic particle into the article surface and to diffuse the particulates in the contact region into the metal coating and into the article surface, thereby securely bonding each ceramic particle to the article surface.

The invention is particularly useful in the fabrication of an abrasive layer on the tip surface of a rotor blade used in a gas turbine engine. For desired operating characteristics, the particle density per unit area of blade tip surface should be maximized, while at the same time the interparticle contact should be minimized. Most importantly, the particles must be securely bonded to the blade tip to withstand the stresses of engine operation, particularly rubbing with air seals. In a preferred embodiment, the ceramic particles are silicon carbide which are coated with aluminum oxide and then overcoated with a nickel-boron alloy. The aluminum oxide prevents diffusion or dissolution of the silicon carbide at elevated temperatures, and the nickel-boron readily diffuses into the blade tip. The binder solution contains a mixture of toluene and diglyme as carrier liquids, polystyrene as an adhesive resin, and nickel flake or powder (both referred to as particulates) as a sintering aid. During the sintering operation, there is simultaneous diffusion of the nickel-boron coating as well as the nickel particulate into the blade tip surface at regions of point contact between each ceramic particle and the tip. Also, some of the nickel particulate diffuses into the nickel-boron coating which remains on each ceramic particle.

After the sintering operation, a matrix alloy is deposited onto the tip surface to cover the silicon carbide particles sintered thereto and to fill in the spaces between the particles. The matrix is then simultaneously heated and pressed to eliminate any voids which may be present, and to securely bond the matrix to the substrate and, by interdiffusion, to the metal coating on each particle. The abrasive layer is then machined to a relatively flat surface, and then part of the matrix is chemically removed to cause portions of the particles to project into space. When blades having such an abrasvie layer are installed in an engine, these exposed particles can effectively rub an airseal during engine operation, and minimize the leakage of working fluids around the blade tips, thus improving engine operating efficiency.

The foregoing and other objects, features and advantages of the present invention will become more apparent from the following description of preferred embodiments and accompanying drawings.

BRIEF DESCRIPTION OF THE DRAWINGS

FIG. 1 generally shows the radially outer portion of a typical gas turbine blade having an abrasive layer made according to the invention;

FIG. 2 shows in cross section the appearance of an abrasive layer produced according to the teachings of the present invention;

FIG. 3 shows in cross section the appearance of a prior art abrasive layer;

BEST MODE FOR CARRYING OUT THE INVENTION

Figure 4:
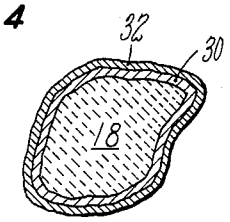
FIG. 4 shows in cross section coated ceramic particles useful in the invention.

The invention is described with reference to the fabrication of an abrasive layer on a gas turbine blade tip. However, those skilled in the art will recognize that the invention is useful in other applications where small particles or components need to be securely bonded to a substrate. The invention is especially useful when the particles are ceramic and the substrate is metal.

In an example of the practice of the invention, and referring to FIGS. 1 and 2, an abrasive layer 10 is formed on the tip surface 11 of the airfoil portion 12 of a gas turbine blade 14. The blade 14 is preferably made of a nickel base superalloy (such as the alloy described in U.S. Pat. No. 4,209,348), while the abrasive layer 10 contains ceramic silicon carbide particles 18 in a nickel base superalloy matrix 16. As is described below, an important feature of the abrasive layer 10 fabricated according to this invention is that each of the particles 18 is securely bonded to the blade tip surface 11.

The abrasive layer 10 is subject to high stresses during engine operation, and therefore it is important that the layer 10 have a certain configuration and properties so as to perform its function. In particular, the particles 18 must be disposed on and secured to the tip surface 11 in a certain manner to obtain optimum performance.

In a prior art abrasive layer 20 for a turbine blade 21 shown in FIG. 3 and discussed in the Background section above, the abrasive particles 22 are randomly dispersed within a matrix metal 24. The abrasive particles 22 are not individually bonded to the blade tip surface 23 as in the invention; rather, the particles 22 are preferably spaced from the surface 23 for reasons related to the bonding process used to join the layer 20 to the surface 23.

Referring again to FIGS. 1 and 2, the abrasive layer 10 made according to the invention is characterized by a single layer of closely spaced abrasive particles 18 surrounded by matrix material 16. The matrix metal 16 has a thickness W which is preferably less than the overall thickness T of the particles 18. As a result, a portion of each particle 18 projects into space, thereby enabling favorable rubbing interaction with air seals during engine operation. For optimum performance, the particles 18 as well as matrix metal 16 must be securely bonded to the blade tip 11. Furthermore, the unexposed portion of the particles 18 must be surrounded by matrix metal 16, and the particles 18 must be closely spaced apart from each other. Use of a single layer of abrasive 18 minimizes the mass of the entire layer 10, thus reducing the centripetal force on the blade 14 as it rotates during engine operation. Also, it allows each particle 18 to be enveloped in matrix material 16 (except the outermost region on each particle 18), thereby enhancing the integrity and strength of the layer 10. In the blade tip made in accordance with the invention, each abrasive particle 18 is sinter bonded to the blade tip 11, and the majority (preferably at least about 80–90%) of the particle surface area (excluding that surface area exposed at the blade tip) is surrounded by matrix metal 16 rather than being in contact with another particle 18. Thus, the particles 18 are all securely joined to the tip 11. Also, the particles 18 are, in general, evenly and densely spaced apart on the blade tip 11. Densities of about 35–110 particles per $cm^2$ of tip surface 11 are preferred, with about 50 particles per $cm^2$ being most preferred.

As shown in FIG. 2, the particles 18 have a thickness (length), T, and the matrix thickness W is about 50–90 percent of the particle thickness T. Silicon carbide particles (nominally about 0.20–0.75 mm in size) have been found to be particularly useful in the practice of the invention, although other sizes might be useful.

Summarizing the fabrication of the abrasive layer 10 according to this invention, the particles 18 are placed in a single layer on the surface of the blade tip 11 which has previously been coated with a low viscosity binder solution which contains fine metal particulates. The blade 14 is then heated to an elevated temperature which sinter bonds each particle 18 to the tip surface 11, and the metal particulates to both the particles 18 and tip surface 11.

Each of the particles 18 is coated with a multiple layer coating. The first layer 30 (FIG. 4) is an oxide coating which is stable at elevated temperatures; this coating prevents the particles 18 from dissolving or diffusing into the blade tip 11 during the elevated sintering (bonding) operation and during service operation. (If the ceramic particles 18 are inherently resistant to reaction at elevated temperatures, the oxide coating 30 may not be necessary.) The preferred oxide coating 30 for silicon carbide particles is aluminum oxide, 0.005–0.025 mm thick, applied in accordance with the aforementioned Johnson et al patent. As shown in FIG. 4, the aluminum oxide coating 30 substantially encapsulates the silicon carbide particle 18. This is necessary to best prevent dissolution and/or diffusion of the particles 18 at high temperatures. The second layer 32 is metallic and capable of diffusing into the tip surface 11 during the high temperature sintering operation. The metallic layer 32 must be compatible with the substrate, i.e., not form any phases or compounds which would degrade the properties of the blade. In general, the layer 32 is selected from the transition elements of the periodic table, or any alloy thereof, when nickel, cobalt, or iron base matrix and blade alloys are used. The metallic layer 32 substantially encapsulates the oxide layer 30. As discussed above, the sinter bond which forms between each particle 18 and the blade tip 11 must have high strength in order for the abrasive layer 10 to have the required characteristics. When an abrasive layer 10 containing silicon carbide particles 18 is made on a nickel base superalloy, these properties are achieved by using a nickel-boron alloy as the metal layer 32. The boron content should be, by weight percent, about 2 to 4%, preferably about 3%. The thickness of the layer 32 should be about 0.005 to 0.015 mm, preferably about 0.008 mm.

Figure 5:
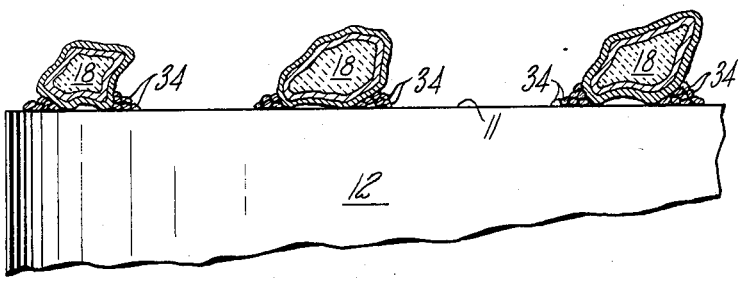
FIG. 5 shows in side view the metal particulates attracted towards the ceramic particles.

Formation of the sinter bond is further improved by coating the blade tip surface 11 with a binder solution before the ceramic particles 18 are placed on the tip 11. The solution contains a thermoplastic resin and fine metallic particulates in a low viscosity carrier liquid. When the particles 18 are placed on the tip surface 11 which has been coated with the binder solution, the resin adhesively bonds each particle 18 to the tip 11. Then, with the passage of time and due to the low viscosity of the carrier liquid, the carrier liquid and particulates 34 are drawn by capillarity into the region of point contact between each ceramic particle 18 and tip surface 11. See FIG. 5. During the high temperature sintering operation, in addition to the aforementioned nickel-boron layer 32 diffusion, the particulates 34 diffuse into the tip surface 11 and into the metal layer 32 on each ceramic particle 18, bridging the gap between each particle 18 and the surface 11, thereby resulting in an even higher strength bond.

The particles 18 may be placed on the blade tip surface 11 in any convenient fashion. The preferred practice is discussed in more detail in the copending and commonly assigned application "Method for Depositing a Layer of Abrasive Material on a Substrate", U.S. Ser. No. 842,591 to Vontell et al, filed Mar. 21, 1986. In this method a vacuum (suction) is drawn through a transfer tool which has spaced apart perforations therein. The tool is then placed over a container of loose particles 18, and the suction draws and holds one particle 18 over each perforation. (Of course, the perforations are smaller than the nominal size of each particle 18.) The tool is then positioned over the blade tip 11 and the suction level is adjusted so that the particles 18 drop onto the tip surface 11.

While the particles 18 lie on the surface of the binder solution coated blade tip 11, the carrier liquid and the metal particulates 34 are drawn into the areas of point contact 36 (i.e., into the joint) between the particles 18 and the tip surface 11. For this movement to take place, the viscosity of the carrier liquid must be low and the particulates 34 must be small. The preferred carrier liquid consists essentially of about 100 cc of toluene and 1 cc of diglyme. It also contains an adhesive resin, preferably about 5 g of polystyrene. The particular choice of this thermoplastic resin is important in the practice of the invention. As has been noted above, the composition of the blade alloy reflects a highly refined metallurgical design which results in the achievement of particular properties. Fabrication of the blade tip must not detrimentally affect these properties. Polystyrene is chosen as the resin binder because when it volatilizes, it depolymerizes and leaves behind no carbon residue. Thermosetting resins are not useful since they do not depolymerize, but rather crosslink, and leave a carbon residue when they volatilize. The presence of carbon on the blade tip surface would result in carburization of the tip during the high temperature sintering operation, which would likely degrade mechanical properties.

Pure nickel flake particulates, nominally about 0.5 to 1.0 microns in size, preferably 0.8 microns, are useful in the invention when the blade is a nickel base superalloy and the ceramic particles are nickel-boron coated silicon carbide. Nickel is preferred since it does not appreciably change the composition of the blade alloy when it diffuses into the tip surface 11.

During the time required for the nickel particulates 34 to coalesce around the abrasive particles 18 (usually about 15–20 minutes for the particular binder solution described above), the diglyme-toluene carrier liquid evaporates, and the particles 18 and particulates 34 become adhesively bonded to the blade tip surface 11. Then, the blade 14 is heated to a temperature sufficient to volatilize the resin and cause the metal layer 32 on the particles 18 to diffuse into the tip surface 11 at regions of point contact. The preferred sintering conditions are about 1,080° C. for 1–6 hours in a non-oxidizing atmosphere. Some of the particulates 34 in the joint diffuse into the tip surface 11 and others diffuse into the metal layer remaining on the particles 18, thereby bridging the joint gap and improving the particle-surface sinter bond. This may be appreciated by examining the bond which forms in the absence of the particulate: since the particles 18 tend to be irregularly shaped, the sinter bond which forms as a result of diffusion of only the Ni-B alloy into the tip surface exists only at the regions of point contact of each particle and the tip. Increasing the Ni-B coating thickness, in an attempt to increase the amount of alloy available for diffusion, does not appreciably increase the bond strength; it only adds unnecessary Ni-B coating thickness to each particle 18. However, when nickel particulates 34 are added to the binder solution, a significantly greater amount of diffusable metal is available to form the sinter bond.

Accordingly, each particle 18 is securely bonded to the tip surface 11 and is thereby capable of providing the required abrasive characteristics to the blade tip 10. Also, few, if any, of the particles 18 are dislodged from the tip surface 11 during a subsequent matrix application step, described below.

Figure 6:
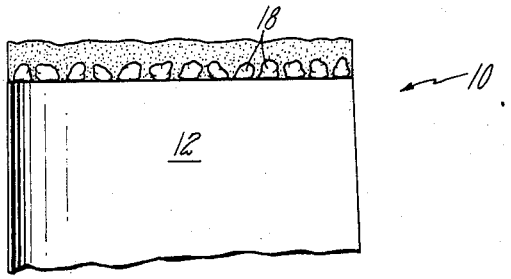
FIG. 6 shows in side view the abrasive layer after application of a metal matrix.

Following the sintering operation, the particles 18 are oversprayed with a layer of matrix material 16 deposited by plasma arc spraying or physical vapor deposition to a thickness T' as shown in FIG. 6. A nickel base superalloy of the type generally described in the aforementioned Johnson et al patent may be used. The preferred matrix composition is, by weight percent, about 25 Cr, 8 W, 4 Ta, 6 Al, 1.0 Hf, 0.1 Y, 0.23 C, balance Ni. Of course, other matrix alloys may be equally useful, such as Hastelloy X, Haynes 188, IN100, or other similar materials.

Although the sprayed layer of matrix material 16 will have about 95 percent theoretical density, it may contain some porosity or voids, which could reduce the mechanical properties of the overall abrasive layer 10. To eliminate such voids, the blade 14 is then subjected to a hot isostatic pressing (HIP) procedure. The HIP treatment also enhances the bond between the matrix 16, particles 18, and blade tip 11. For the specific superalloy matrix material described above, a temperature of about 1,100° C. and a gas pressure of about 138 MPa applied for two hours is sufficient. Other hot pressing procedures may be used to consolidate the matrix material 16 and achieve the object of densification and bonding.

Next, the surface of the abrasive layer 10 is machined using a conventional procedure such as grinding to produce a smooth, planar surface. Finally, the surface of the abrasive layer 10 is contacted with a chemical etchant or other substance which will attack and remove some of the matrix material 16, causing a portion of each of the particles 18 to project into space. For example, electrochemical machining can be used, as is described in U.S. Pat. No. 4,522,692 to Joslin. This step reduces the matrix thickness to a dimension W, which is about 50–90 percent of the dimension T, and results in an abrasive layer 10 having the shape schematically shown in FIG. 2.

It has been found that there is a criticality in the aspect ratio of the particles 18, relevant to obtaining an abrasive layer 10 which contains a high density of uniformly spaced apart particles 18. When the particles are long and thin (i.e., have a high aspect ratio), they tend to lie on their sides either when first placed on the blade tip surface 11 or in the interval between the volatilization of the adhesive agent and the attainment of a metallic bond. Such laying-at-length causes undue interparticle contact, and reduces the abrasive nature of the layer 10. Thus, the invention is best practiced when the aspect ratio of the particles is less than about 1.9 to 1 and preferably is about 1.5 to 1 or less. The aspect ratio is defined herein as the average ratio of the longest particle dimension to the cross sectional dimension, as such is measured on a Quantimet Surface Analyzer (Cambridge Instruments, Cambridge, England).

The sintering aspect of the invention will be better understood by referring to the following example which is intended to be illustrative, and not limiting in scope.

Nominal 0.30 mm silicon carbide particles were coated with a dual layer coating of 0.0015 cm aluminum oxide and 0.0008 cm nickel-3% boron. A binder solution containing nickel flake having a size range of about 0.5–1.0 microns, polystyrene, toluene and diglyme was prepared and applied to the tip surface of nickel base superalloy test blades. Binder solutions containing varying amounts of nickel flake were evaluated to examine the effect of such variation on the strength of the sinter bond which formed. The binder solutions were brushed on the blade tip surface and then the ceramic particles placed thereon. The particle density was ranged between about 50–100 per square $cm^2$. After about 20 minutes, the blade was heated at 1,975° F. in argon and held for 1–6 hours, as shown in Table I. To examine the strength of sinter bonds, impact tests were conducted. In these tests, a ten pound weight was dropped onto each test blade from a height of about 28 cm. The strength of the bond was characterized by comparing the number of particles bonded to the tip before the test with the number bonded to the tip after the test. This ratio is presented in Table I as "% Grit Retention". Of course, high percentages are indicative of good bonds. As is seen, when no nickel flake was added to the binder solution, many particles were dislodged during the impact test, indicating a poor bond. Improved results were achieved as the amount of nickel flake increased. The maximum amount of nickel flake which will be useful is dictated by two factors: (1) how the diffusion of such flake alters the composition of the blade tip, and (2) how the viscosity of the binder solution is affected by addition of the flake. Between about 0.5 and 15 grams of the 0.5–1.0 micron nickel powder or nickel flake will be useful when the diffusion heat treatment is about 1,975° F. for 1–6 hours. The preferred range is 0.5–4 grams for 1–2 hours at 1,975° F.

Carrier liquids other than the preferred toluene-diglyme mixture may be used, such as, e.g., xylene or mixtures of xylene and toluene. They must have a low viscosity, for reasons discussed above, of no greater than about 1–10 centistokes. Also, they should have the same evaporation characteristics as the preferred mixture. Thermoplastic resins such as polymethylstyrene may be used rather than polystyrene.

Although this invention has been shown and described with respect to a preferred embodiment, it will be understood by those skilled in the art that various changes in form and detail thereof may be made without departing from the spirit and scope of the claimed invention.

TABLE I

Effect of Nickel Flake Content and Sintering Time on Grit Retention

| Specimen | Ni Flake Content* grams | Sintering Time at 1,975° F., Hours | % Grit Retention |
|---|---|---|---|
| A | 0 | 6 | 65 |
| B | 0.25 | 2 | 93.6 |
| C | 0.5 | 2 | 99 |
| D | 1 | 2 | 97 |
| E | 1 | 1 | 81 |
| F | 2 | 1 | 95.5 |
| G | 3 | 1 | 96 |
| H | 3 | 2 | 100 |
| I | 4 | 1 | 98.4 |
| J | 8 | 6 | 100 |

*Amount of nickel flake added to 30 cc of a binder solution containing 100 cc toluene, 1 cc diglyme, and 5 grams polystyrene.

I claim:

1. A method for joining a plurality of ceramic particles to the surface of a metallic article used at elevated temperatures, comprising the steps of:

(a) depositing on each particle a multiple layer coating comprising a first oxide layer stable at elevated temperatures, and a second metal layer compatible with and capable of diffusing into the article surface;

(b) coating the article surface with a binder solution consisting essentially of a low viscosity carrier liquid, a thermoplastic resin, and fine metal particulates, wherein the resin leaves no carbon residue on the article surface after volatilization, and the metal particulates are substantially smaller than the ceramic particles and are capable of diffusing into the article surface and into the metal layer on the ceramic particles;

(c) disposing a single layer of the ceramic particles in closely spaced relation on the article surface, wherein the binder solution and a plurality of the metal particulates therein are attracted by capillarity into the joint between the ceramic particles and the article surface; and (d) heating the article to diffuse at least a portion of the metal layer on each ceramic particle into the article surface and diffuse the metal particulates in said joint into said metal layer and into the article surface.

2. A method for joining a plurality of silicon carbide particles to the tip surface of a nickel base superalloy article, comprising the steps of:

(a) depositing on each particle a two layer coating, wherein the first layer is aluminum oxide and the second layer is a nickel-boron alloy, wherein the aluminum oxide coating substantially encapsulates the silicon carbide particle and the nickel-boron coating substantially encapsulates the aluminum oxide coating;

(b) coating the blade tip surface with a binder solution consisting essentially of toluene, diglyme, polystyrene, and fine nickel particulates, wherein the particulates are much smaller than the silicon carbide particles;

(c) disposing a single layer of the silicon carbide particles in spaced apart relation on the tip surface, wherein the binder solution and a plurality of nickel particulates therein are attracted by capillarity into the joint between each silicon carbide particle and the tip surface; and (d) heating the article at a temperature sufficient to volatilize the toluene, diglyme, and polystyrene, and to diffuse a portion of the nickel-boron coating on each silicon carbide particle into the tip surface and diffuse the nickel particulate in said joint into the nickel-boron coating and into the tip surface.

3. The method of claim 2, further comprising the steps of:

(a) depositing on the tip surface a metallic matrix material to fill in the spaces between the silicon carbide particles; and (b) removing a portion of the matrix material to cause a portion of each of the particles to project into space.

4. The method of claim 3, wherein the matrix material is plasma sprayed.

5. The method of claim 3, wherein the superalloy article is a gas turbine engine blade.

6. The method of claim 2, wherein the silicon carbide particles are about 0.2–0.5 mm and the nickel particulates are about 0.5–1.0 microns.

* * * * *